US005547194A

United States Patent [19]

Aizawa et al.

[11] Patent Number: 5,547,194

[45] Date of Patent: Aug. 20, 1996

[54] GOLF CLUB HEAD

[75] Inventors: Yuichi Aizawa; Mahito Kimura; Yasuto Imai, all of Tokyo, Japan

[73] Assignee: Daiwa Seiko, Inc., Tokyo, Japan

[21] Appl. No.: 375,108

[22] Filed: Jan. 19, 1995

[30] Foreign Application Priority Data

| | | | |
|---|---|---|---|
| Jan. 19, 1994 | [JP] | Japan | 6-003961 |
| Jan. 21, 1994 | [JP] | Japan | 6-005046 |
| Nov. 17, 1994 | [JP] | Japan | 6-283176 |
| Nov. 17, 1994 | [JP] | Japan | 6-283590 |

[51] Int. Cl.[6] ..... A63B 53/04

[52] U.S. Cl. ..... 473/350; 473/342

[58] Field of Search ..... 273/167 H, 167 F, 273/169, 173, 168, 77 A, 78, 171, 167 A, 167 J, 167 G

[56] References Cited

U.S. PATENT DOCUMENTS

| | | | |
|---|---|---|---|
| 3,814,437 | 6/1974 | Winquist | 273/167 H |
| 4,915,386 | 4/1990 | Antonious | 473/350 |
| 5,014,993 | 5/1991 | Antonious | 273/169 |
| 5,048,835 | 9/1991 | Gorman | 273/167 H |
| 5,242,167 | 9/1993 | Antonious | 473/350 |
| 5,290,032 | 3/1994 | Fenton et al. | 273/169 |
| 5,328,184 | 7/1994 | Antonious | 273/167 H |
| 5,423,535 | 6/1995 | Shaw et al. | 273/173 |
| 5,447,307 | 9/1995 | Antonious | 273/169 |

FOREIGN PATENT DOCUMENTS

| | | |
|---|---|---|
| 55-277 | 1/1980 | Japan . |
| 59-12914 | 4/1984 | Japan . |

*Primary Examiner*—Steven B. Wong
*Attorney, Agent, or Firm*—Longacre & White

[57] ABSTRACT

The invention concerns an arrangement for a golf club head, which can enhance the surface rigidity of the ball hitting surface of a face plate to extend the carry of the ball and to stabilize the direction of the hit ball. In the golf club head, a recessed portion is formed in the back portion of a head main body formed of metal with the peripheral edge portion thereof remaining unrecessed, and a support portion having a thickness smaller than the peripheral edge portion is provided integrally with the head main body in such a manner that it is interposed between the mutually facing inner walls of the recessed portion.

8 Claims, 11 Drawing Sheets

GOLF CLUB HEAD

BACKGROUND OF THE INVENTION

1. Field of the Invention

The present invention relates to a golf club head designed to stabilize the direction of a hit ball and carry the hit ball further. The present invention also relates to a set of iron clubs having such golf club heads.

2. Discussion of Prior Art

Generally, a head main body of an iron club is formed of metal such as soft iron, stainless steel or the like to have integral hosel, sole and face portions. The head main body of the golf club head varies in shape according to the iron club numbers. It is widely known that a recessed portion is formed on the back side of the head main body with the peripheral edge portion thereof remaining unrecessed as it is, to increase the moment of inertia of the head main body and stabilize the direction of the hit ball.

In view of tile above fact, in recent years, there have been proposed several kinds of iron clubs. For example, according to an iron club which is shown in FIGS. 22 and 23, in the ball hitting surface of a head main body 1 formed of metal, there are formed a through hole 2 and a fitting recessed portion 3 in the peripheral edge portion of the through hole 2, and also a thin face plate 4 having elasticity is fitted into the fitting recessed portion 3 to thereby form a recessed portion 6 in the back portion 5 of the head main body 1 (see Japanese Utility Model Publication No. 55-277 of Showa). Also, according to an iron club which is shown in FIG. 24, in the back portion 8 of a head main body 7, there is formed a recessed portion 9, with the peripheral portion thereof remaining unrecessed as it is, to thereby form a thin ball hitting surface 11 in the face portion of the head main body 7.

In other words, according to the above iron clubs, since the recessed portions 6, 9 are formed in the back portions 5, 8 with the peripheral edge portions remaining untreated, the weights of the head main bodies 1, 7 are dispersed around the peripheral edge portions thereof, thereby being able to increase the moments of inertia of the head main bodies 1, 7 and thus to stabilize the direction of the hit ball.

On the other hand, however, since the recessed portion 6 is formed in the back portion 5 of the head main body 1 by fitting the thin face plate 7 into the through hole 2 formed in the head main body 1, or, since the thin ball hitting surface 11 is formed in the face portion 10 by forming the recessed portion 9 in the back portion 8, the above-mentioned iron clubs lack in surface rigidity when hitting the ball and thus there is a possibility that the face plate 7 and the ball hitting surface 11 can be broken, or, the lack of surface rigidity makes it impossible to extend the carry of the hit ball.

Also, in Japanese Utility Model Publication No. 59-12914 of Showa, there is disclosed an iron club set in which, as shown in FIGS. 25 to 27, not only a recessed portion 14 is formed in the back portion 13 of a head main body 12 with the peripheral edge portion thereof remaining unrecessed, and a rib-shaped heavy weight portion 15 is so provided in the recessed portion 14 as to extend from the top side peripheral edge portion to the sole side peripheral edge portion, but also the heavy weight portion 15 is gradually moved in position according to the kinds of iron clubs, that is, as the iron clubs vary in the order of a long iron club 16 shown in FIG. 25, a middle iron club 17 shown in FIG. 26 and a short iron club 18 shown in FIG. 27, the position of the heavy weight portion 15 is moved from a position near the toe portion of the head main body to a position near the heel portion thereof.

Therefore, according to the respective iron clubs, the heavy weight portion 15 keeps the head main body 12 in a proper inclination to thereby be able to prevent the ball from being hooked or sliced.

In the above-mentioned iron club, however, since the heavy weight portion 15 is so formed as to have the same thickness (height) as the peripheral edge portion on the back side of the head main body 12, the weight of the iron club is heavy.

Therefore, in tile above-mentioned head main body 12, in spite of the fact that the recessed portion 14 is formed on the back portion 13 with the peripheral edge portion thereof remaining unrecessed, the weight of the head main body 12 is not dispersed to the peripheral edge portion thereof and thus the moment of inertia is reduced, with the result that the flying direction of the hit ball cannot be stabilized.

In addition, it is not clear whether the heavy weight portion 15 is disposed at a position of the back portion 13 corresponding to the sweet spot (in the present invention, the sweet spot corresponding position means a position in which a perpendicular line drawn from the sweet spot of the face portion of the head main body intersects the back portion of the head main body), and thus the heavy weight portion 15 is not helpful so much in enhancing the surface rigidity of the sweet spot of the ball hitting surface. For this reason, in fact, it cannot be expected that the carry of the hit ball can be extended.

Also, it is generally known that, in a golf club set of this kind, if the center of gravity of a head main body of a long iron is lowered, then the hit ball can be flown high and thus the carry of the hit ball can be extended; and, if the center of gravity of a head main body is moved upwardly as the number of iron clubs increases, then the direction of the head (face) can be intentionally changed and thus the direction of the hit ball can be controlled easily. However, in the golf club set shown in FIGS. 25 to 27, although the right and left direction of the hit ball is considered, that is, prevention of the hooked or sliced ball is considered, in fact, no consideration is given to the adjustment of the center of gravity of the head main body 1.

Therefore, not only the surface rigidity of the sweet spot cannot be expected, but also the carry of the hit ball cannot be secured by the long iron 16 shown in FIG. 25 and the direction of the hit ball still remains difficult to control when using the middle iron 17 and the short iron 18 shown in FIGS. 26 and 27.

SUMMARY OF THE INVENTION

The present invention aims at eliminating the drawbacks found in the above-mentioned conventional golf club heads. Accordingly, it is an object of the invention to provide a novel arrangement for a golf club head, which enhances the surface rigidity of the ball hitting surface of a face plate, particularly in the vicinity of the sweet spot, to thereby improve the protection of the ball hitting surface, extend the carry of the hit ball and stabilize the direction of the hit ball. Another object of the invention is to provide a novel variation for a golf club set comprising at least three irons, i.e. long, middle and short irons, which enhances the stability of the direction of the hit ball and the surface rigidity of the sweet spot to thereby be able to secure the carry of the ball when it is hit by the present long irons as well as to facilitate the control of the direction of the ball when it is hit by the present middle and short irons.

In order to attain the above-noted and other objects, the present invention provides a golf club head in which a recessed portion is formed in the back portion of a head main body preferably formed of metal with the peripheral edge portion left unrecessed, and a support portion having a thickness smaller than the peripheral edge portion of the back portion is provided integrally with the head main body between the mutually facing inner walls of the recessed portion.

In the golf club head, the support portion is so provided as to extend from the top side of the head main body to the sole side thereof. Alternatively, the support portion may be so provided as to extend from the heel side of the head main body to the toe side thereof.

In the golf club head, it is preferable the support portion passes through the sweet spot corresponding position. The support portion may be greater in thickness in the sweet spot corresponding position than in the remaining portions of the support portion.

Further, in the golf club head, preferably, the support portion is increased in width toward the sole side of the head main body, or toward the toe side of the head main body. Two support portions may be so provided as to extend from the top side of the lead main body to the sole side thereof with the sweet spot corresponding position between them.

Moreover, in the golf club head, the recessed portion of the head main body may be formed or closed by mounting a face plate, which is formed of material lighter in specific gravity than the head main body, on the face portion side of a through hole so formed as to extend from the face portion of the head main body to the back portion thereof, and the support portion(s) is (are) in contact with the back side of the face plate.

According to the golf club head, since the support portion is small in thickness while it is provided within the recessed portion in the back portion of the head main body, the weight of the head main body is dispersed to the peripheral edge portion thereof and thus the moment of inertia thereof is increased.

Therefore, when a golf player swings a golf club with a golf club head according to the invention, then the head main body does not shift or vibrate but draws an accurate locus when hitting the ball and thus the direction of the hit ball can be stabilized, also the support portion of the head main body can support and reinforce the ball hitting surface of a face plate or the like.

According to the golf club head in which the support portion thereof passes through the sweet spot corresponding position, as well as according to the golf club head in which the two support portions are situated on the heel and toe sides of the head main body with the sweet spot corresponding position between them, the support portion(s) supports and reinforces the ball hitting surface of the sweet spot.

The present invention further provides a golf club set comprising at least three iron clubs, i.e. long, middle and short irons, in which a recessed portion is formed in the back portion of a head main body of each of the irons with the peripheral edge portion thereof remaining unrecessed, a support member is provided in the recessed portion integrally with the head main body in such a manner that it extends from the top side of the peripheral edge portion to the sole side thereof and passes through a sweet spot corresponding position, and the weight of the support member on the sole side of the peripheral edge portion is reduced sequentially in the order of the long, middle and short irons.

In the golf club set according to the invention, the width of the support member on the sole side of the peripheral edge portion is preferably reduced sequentially in the order of the long, middle and short irons. The thickness of the support member on the sole side of the peripheral edge portion is preferably reduced sequentially in the order of the long, middle and short irons.

According to the present golf club set of the invention, the weight of the long irons on the sole side of the head main body thereof is greater than that of the middle and short irons and, therefore, the centers of gravity of the head main body of the long irons are situated lower than those of the middle and short irons. As the number of the irons increases toward the short irons or in the order of the long, middle and short irons, the centers of gravity of the head main bodies of the irons are sequentially moved upward.

As the number of the irons increases toward or in the order of the middle and short irons, along with the movement of the sweet spot, the support member is moved from the toe side of the head main body to the heel side thereof and thus, when hitting the ball, the support member holds the head main body in a proper angle of inclination to thereby prevent the ball from being hooked or sliced.

In the long iron, since the surface rigidity of the sweet spot thereof is increased, a golf ball can be flown higher and farther with the faster initial speed thereof when it is hit by the present long iron, when compared with the conventional long irons, and also, as the number of the irons increases, the surface rigidity of the sweet spot is reduced to thereby extend the time of contact with the ball when hitting the ball, so that more spin can be given to the hit ball.

DETAILED DESCRIPTION OF THE PREFERRED EMBODIMENTS

Preferred embodiments of the invention will now be described in detail with reference to the accompanying drawings.

Figure 1:
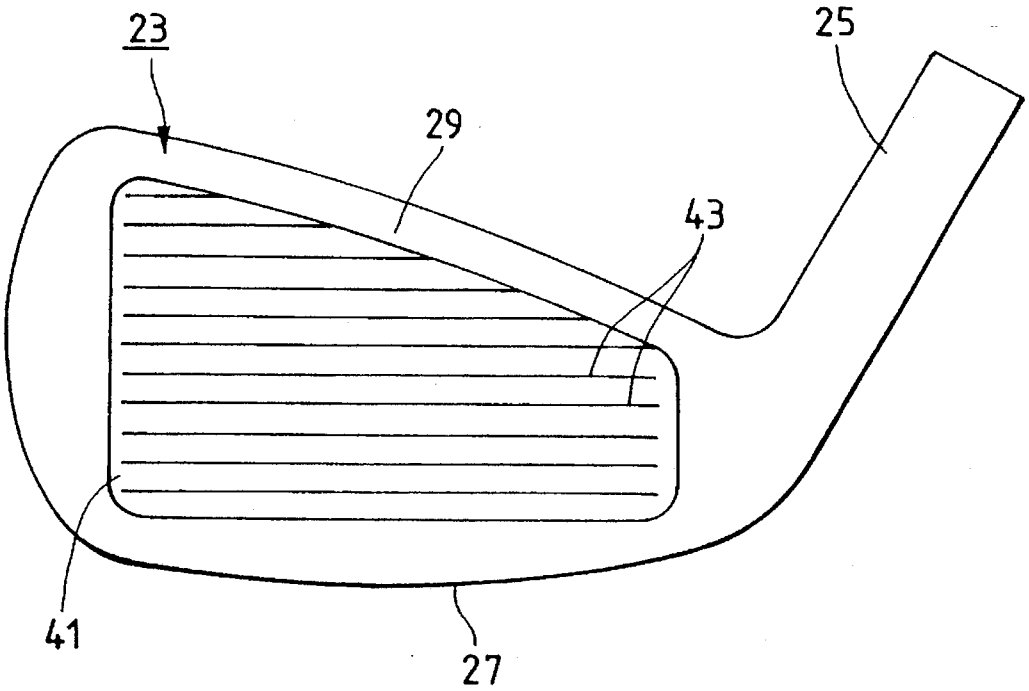
FIG. 1 is a front view of a golf club head according to a first embodiment of the invention.
Figure 2:
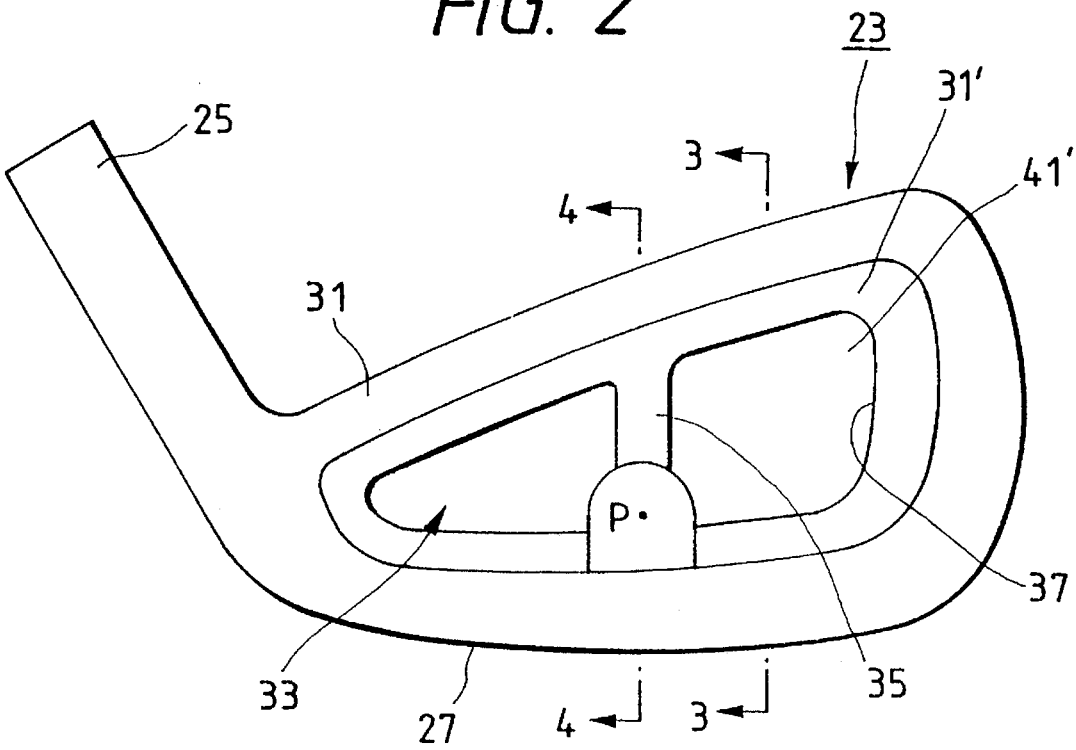
FIG. 2 is a back view of the golf club head shown in FIG. 1.
Figure 3:
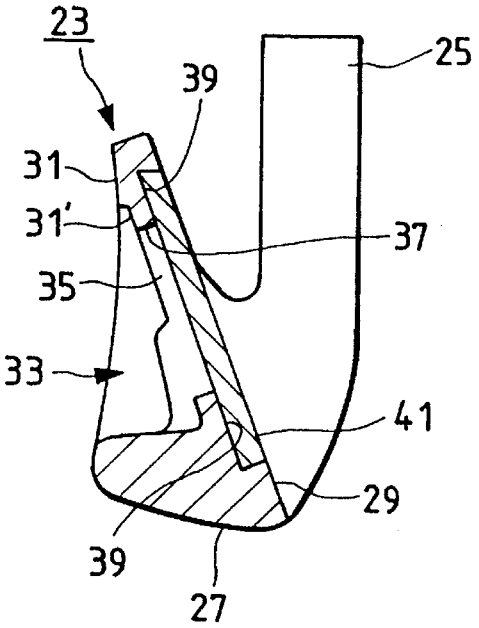
FIG. 3 is a section view taken along the line 3—3 of FIG. 2.
Figure 4:
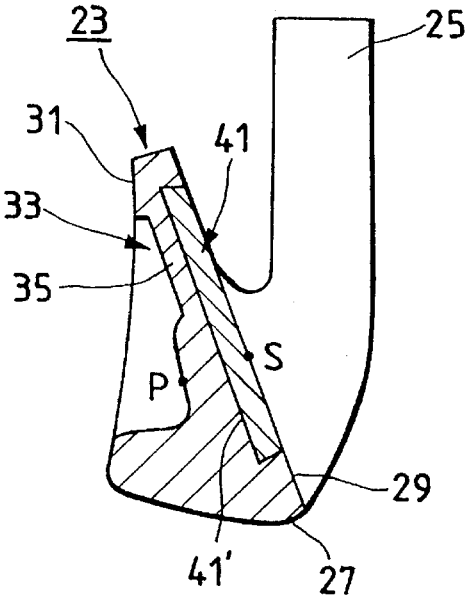
FIG. 4 is a section view taken along the line 4—4 of FIG. 2.

FIGS. 1 to 4 show a golf club head according to a first embodiment of the invention. In these figures, reference character 23 designates a head main body of an iron club formed mainly of stainless steel, and the head main body 23 includes a hosel portion 25, a sole portion 27, a face portion 29 and the like which are formed integrally with one another. As shown in FIGS. 2 to 4, in the back portion 31 of the head main body 23, a recessed portion 33 is formed while the peripheral edge portion therearound is left untreated or unrecessed.

Further, a rib-shaped support portion 35 having a thickness smaller than the peripheral edge portion of the head main body is formed integrally in the head main body 23 in such a manner that it passes through a sweet spot corresponding position P (a position in which a line perpendicular to face plate 41 drawn from the sweet spot S down to the side of the back portion 31 see FIGS. 2 and 4 of the head main body 23 where it intersects the back portion 31) in order to increase the surface rigidity of the ball hitting surface in the vicinity of the sweet spot S. The support portion 35 is interposed between the mutually facing inner walls of the recessed portion 33 and extends from the top side of the head main body 23 to the sole side thereof. If the further increase of the surface rigidity at the sweet spot S is required, the thickness of a lower portion of the support portion 35 may be increased as in the present embodiment shown in FIGS. 2 and 4. That is to say, the thickness of the lower portion of the support portion 35 extending downwardly from a slightly upper level of the sweet spot corresponding position P to the lower inner wall of the recessed portion 33 may be set substantially equal to or slightly larger than the thickness of the upper portion of the upper peripheral portion of the head main body to the extent the thickness of the lower portion of the support portion 35 is sufficiently smaller than the thickness of the lower peripheral portion of the head main body and the thickness of the remaining upper portion of the support portion 35 is kept smaller than the thickness of the upper peripheral portion of the head main body. By forming the support portion 35 thicker at the sweet spot corresponding position P, the surface rigidity in vicinity of the sweet spot S of the club head can be further increased.

At the bottom of the above-mentioned recessed portion 33, there is formed a through hole 37 passing through the head main body 23 and extending from the face portion 29 to the back portion 31. A thin face plate 41 having a uniform thickness and formed of titanium is securely fitted into a fitting recessed portion 39 formed in the periphery of the through hole 37 on the side of the face portion 29. The outer shape of the fitting recessed portion is larger than the outer shape of the through hole 37 to provide a support surface around the through hole 37. As shown in FIGS. 3 and 4, the back side (rear surface) 41' of the face plate 41 is brought into contact with and supported by the support portion 35 and the fitting recessed portion 39.

Further, as shown in FIG. 1, the outer shape of the face plate 41 is so formed as to be identical with the outer shape of the fitting recessed portion 39, and the face plate 41 is made flush with the face portion 29 when the face plate 41 is inserted into the fitting recessed portion 39. The face plate 41 is formed with a plurality of score lines 43 on the hitting surface thereof to provide a spin of the hit ball.

Furthermore, a step portion 31' is formed in the back portion 31 of the head main body within the recessed portion 33 and located between the peripheral edge portion of the head main body and the through hole 37. The step portion 31' circumscribes the through hole 37, and the thickness of the step portion 31' is smaller than the peripheral portion of the head main body. A surface of the step portion, located opposite from the back portion 31 (i.e. the side of the face portion 29) is brought into contact with the rear surface 41' of the face plate 41. The step portion 31' serves to absorb the excessive impact to prevent the damage of the peripheral portion of the face plate 41 due to the abrupt change in surface rigidity between the peripheral portion of the face plate 41 which is supported by the fitting recessed portion 39 and another portion of the face plate 41 which is not supported.

As described above, in the present embodiment, the through hole 37 is formed in the head main body 23, the through hole 37 is covered with the face plate 41 having a specific gravity lighter than the head main body 23, the recessed portion 33 is formed in the back portion 31 of the head main body 23 with the peripheral edge portion thereof left unrecessed, the support portion 35 having a thickness smaller than the peripheral edge portion is provided within the recessed portion 33 in such a manner that it passes through the sweet spot corresponding position P, and the support portion 35 is structured such that only the portion at the sweet spot corresponding position P is larger in thickness. That is, according to the present embodiment, since the support portion 35 has a smaller thickness, in spite of provision of the support portion 35 the weight of the head main body 23 is dispersed to the peripheral portion thereof and thus the moment of inertia thereof is increased. Further, the support portion 35 passes through the sweet spot corresponding position P, the surface rigidity of the sweet spot S is increased.

Therefore, if a golf player swings a golf club incorporating a golf club head according to the present embodiment, then the head main body 23 does not vibrate or shift and can draw an accurate locus owing to its moment of inertia when hitting the ball, so that the direction of the hit ball can be stabilized when compared with the conventional iron club. Further, since the support portion 35 supports and reinforces the face plate 41 to thereby enhance the surface rigidity of the sweet spot S, there is eliminated the danger that the face plate 41 can be broken due to shocks given when hitting the ball.

Furthermore, since the face plate 41 is formed uniform so that the ball hitting surface thereof is made parallel to the rear surface 41', and further the support portion 35 is structured so that the surface thereof for supporting the face plate 41 is substantially parallel to the ball hitting surface of the face plate 41, the face plate 41 in cooperation with the support portion 35 can efficiently convert the stored elastic energy into repulsive energy. This arrangement further enhances the effect delivered from the high surface rigidity at the sweet spot S, and therefore the club head according to the embodiment can carry the hit ball further with the stabilized direction of the hit ball.

If the face plate 41 is provided as a separate member from the head main body 23, the desired highly elastic material suitable for hitting the ball can be selected as the material for the face plate 41. Further, since the head main body 23 is formed with the through hole 37, the repulsive property of the face plate 41, which is inherent in the material thereof, can be used effectively.

Figure 23:
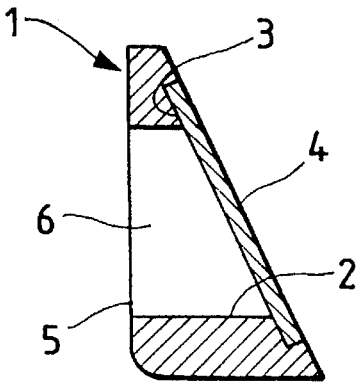
FIG. 23 PRIOR ART
FIG. 23 is a section view of the golf club head shown in FIG. 22.
Figure 24:
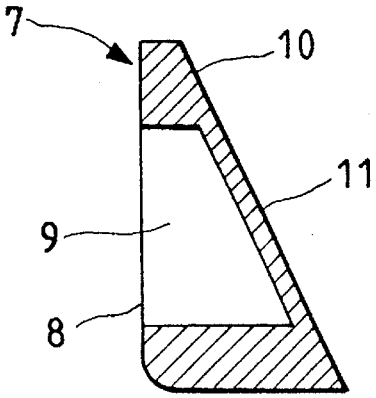
FIG. 24 PRIOR ART
FIG. 24 is a section view of another conventional golf club head.

Moreover, when hitting the ball, the concentrated stresses cause the face plate 41 to bend slightly, and this slight bent may cause a problem, in the conventional iron club head as shown in FIG. 23, that the peripheral edge portion of the face plate 4 is likely to be separated from the fitting recessed portion 3 of the lead main body 1. However, the golf club head of the present invention is free from this problem. That is to say, according to the present embodiment, the support portion 35 serves not only to increase the surface rigidity of the face plate 41 but also to securely prevent the excessive bending of the face plate 41 at the hitting of the ball. The support portion 35 is also elastically deformed synchronously with the elastic deformation of the face plate 42 while preventing the excessive bending of the face plate 42, and further serves to simultaneously convert the elastic energy stored in the face plate 41, the support portion 35 and the head main body into the repulsive energy carrying the hit ball. Thus, it is possible to surely prevent the above-mentioned separation and damage of the face plate while efficiently converting the stored energy into the repulsive energy.

Figure 5:
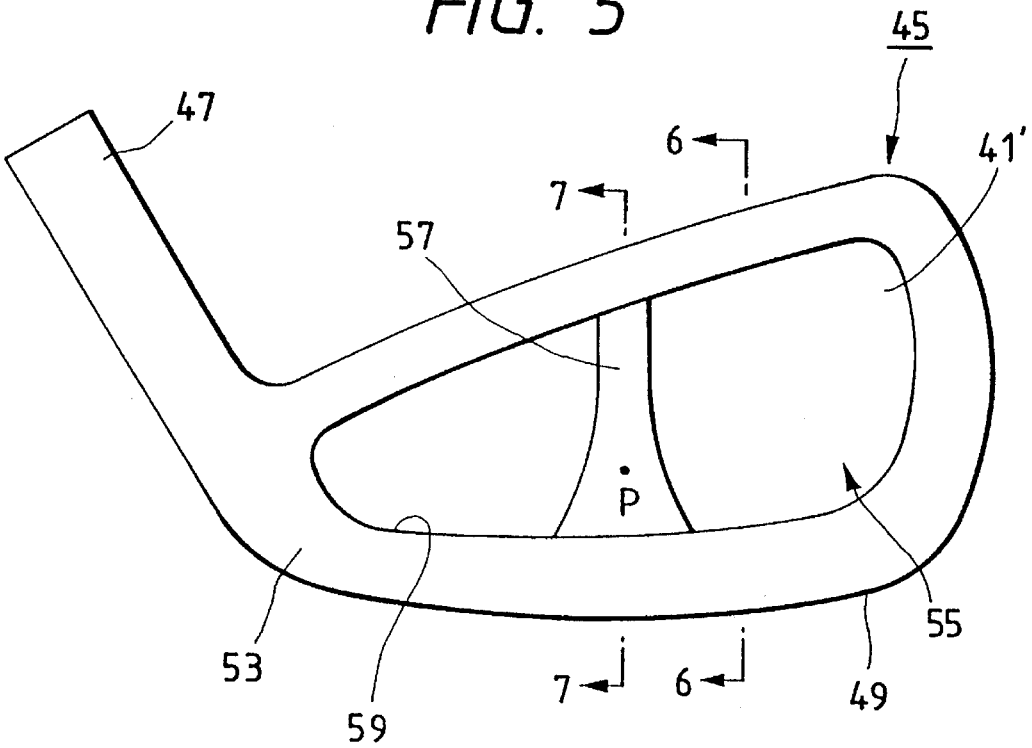
FIG. 5 is a back view of a golf club head according to a second embodiment of the invention.
Figure 6:
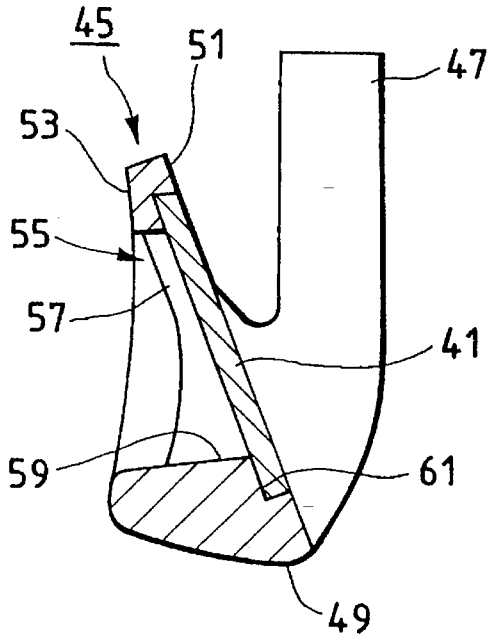
FIG. 6 is a section view taken along the line 6—6 of FIG. 5.
Figure 7:
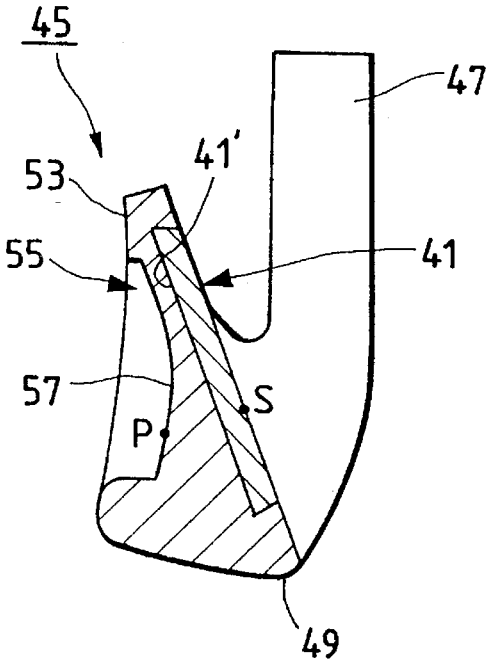
FIG. 7 is a section view taken along the line 7—7 of FIG. 5.

FIGS. 5 to 7 show a golf club lead according to a second embodiment of the invention. In these figures, reference character 45 designates a head main body of an iron club formed of stainless steel. The present head main body 45, similarly to the head main body 23, includes a hosel portion 47, a sole portion 49, a face portion 51 and the like which are formed integrally with one another. The head main body 45 also includes a back portion 53 in which a recessed portion 55 is formed and the peripheral edge portion thereof remaining unrecessed.

In the recessed portion 55, a rib-shaped support portion 57 is provided integrally with the head main body 45 in such a manner that it is interposed between the mutually facing inner walls of the recessed portion 55 and extends from the top side of the head main body 45 to the sole side thereof. A portion of the support portion 57 is formed sufficiently smaller in thickness than the peripheral edge portion of the back portion 53 or head main body 45 and the rest of the support portion 57 is so formed as to gradually increase in width and thickness toward the sole side of the head main body 45 from the neighborhood of the sweet spot corresponding position P.

The recessed portion 55, as shown in FIG. 6, is formed in such a manner that a through hole 59 passes through the head main body 45 and extends from tile face portion 51 to the back portion 53. A face plate 41 is fitted into a fitting recessed portion 61 formed in the periphery of the through hole 59 and located on the side of the face portion 51. As shown in FIG. 7, the rear surface 41' of the face plate 41 is in contact with and is supported by the support portion 57.

In the present embodiment as well, the outer shape of the face plate 41 is formed identical with the fitting recessed portion 61, and if the face plate 41 is fitted into the fitting recessed portion 61, then the face plate 41 can be surely set flush with the face portion 51.

As described above, instead of the support portion 35 shown in FIG. 2, in the present embodiment, there is provided in the recessed portion 55, the rib-shaped support portion 57, which is formed such that not only is it smaller in thickness than the peripheral edge portion of the head main body 45 but also it is gradually increased in width and thickness toward the sole side from the neighborhood of the sweet spot corresponding position P. The support potion 57 is provided integrally with the head main body 45 in a manner to extend from the top side of the head main body 45 to the sole side thereof. For this reason, according to the present embodiment as well, in spite of provision of the support portion 57, the weight of the head main body 45 can be dispersed to the peripheral edge portion thereof and thus the moment of inertia of the head main body 45 is increased. Further, the surface rigidity of the sweet spot S can be increased, particularly at the position of the sweet spot S.

Figure 22:
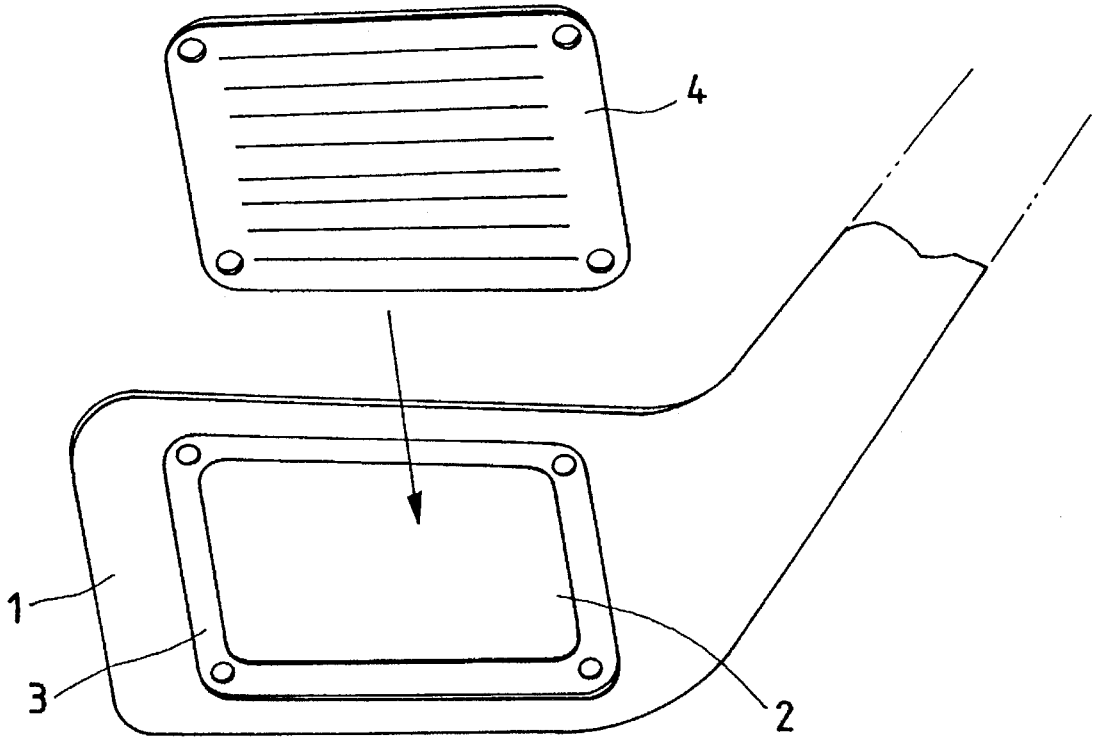
FIG. 22 PRIOR ART
FIG. 22 is an exploded perspective view of a conventional golf club head.

Therefore, if a golf player swings a golf club incorporating a golf club head according to the present embodiment, then the head main body 45 can draw an intended, accurate locus due to its moment of inertia. Thus, similarly to the previously described embodiment, according to the present embodiment as well, not only the direction of the hit ball can be stabilized when compared with the conventional golf club heads respectively shown in FIG. 22 and its following figures, but also the support portion 57 supports and reinforces the face plate 41 to enhance the surface rigidity of the sweet spot S, thereby eliminating the possibility that the face plate 41 can be broken due to shocks given when hitting the ball as in the conventional iron club shown in FIG. 23.

Further, similarly to the previously described embodiment, since the support portion 57 is structured such that the surface thereof for supporting the face plate 41 forms a surface substantially parallel to the ball hitting surface of the face plate 41, the support portion 57 can support the face plate 41 efficiently and effectively to thereby convert the elastic or repulsive property thereof into repulsive energy.

Therefore, due to combination of this property with the increased surface rigidity of the sweet spot S, the present golf club head not only can secure the more stabilized direction of the hit ball but also can extend the carry of the hit ball when compared with the conventional golf club heads.

Further, in the present embodiment as well, if there is used a face plate 41 which is formed separately from the head main body 45, then the highly elastic material that is suitable for hitting the ball can be selected as the material of the face plate 41 and, since the head main body 45 includes the through hole 59, a repulsive property inherent in the elastic material can be used effectively.

Moreover, generally, when hitting the ball, due to the concentration of stresses, the face plate 41 is caused to bend slightly. According to this embodiment, however, the support portion 57 enhances the surface rigidity of the face plate 41 as well as relieves the bending of thereof when hitting the ball, and the support portion 57 also acts in cooperation with the head main body 45 in bending the face plate 41, thereby being able to prevent the separation or breakage of the face plate 41 more reliably.

Figure 8:
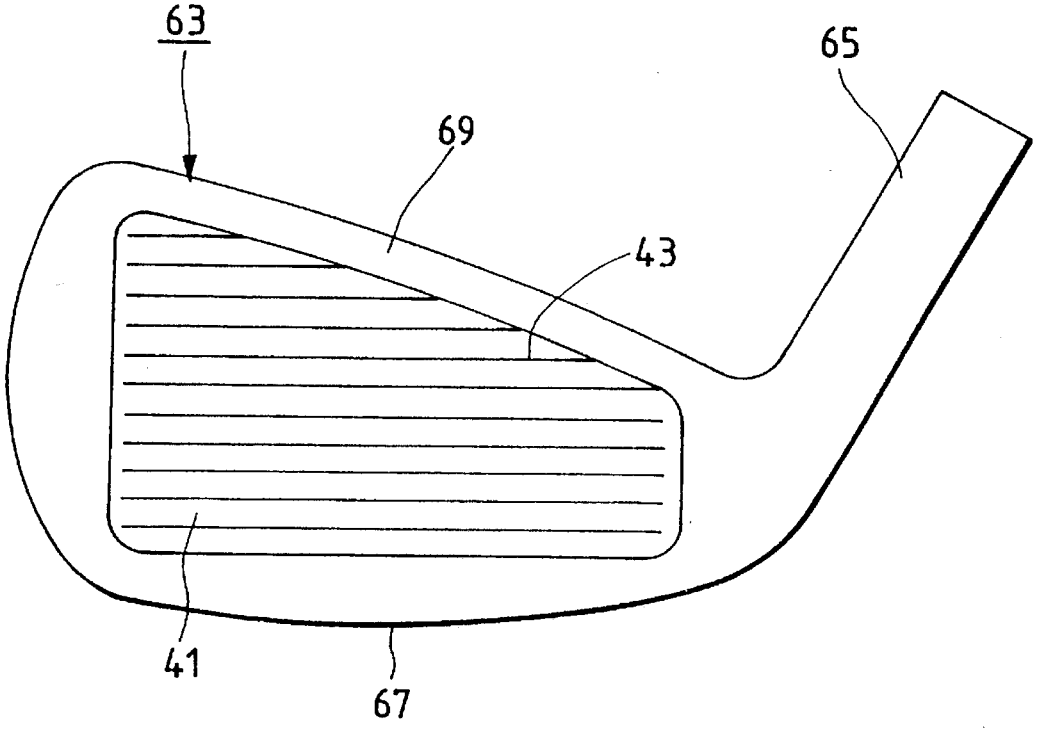
FIG. 8 is a front view of a golf club head according to a third embodiment of the invention.
Figure 9:
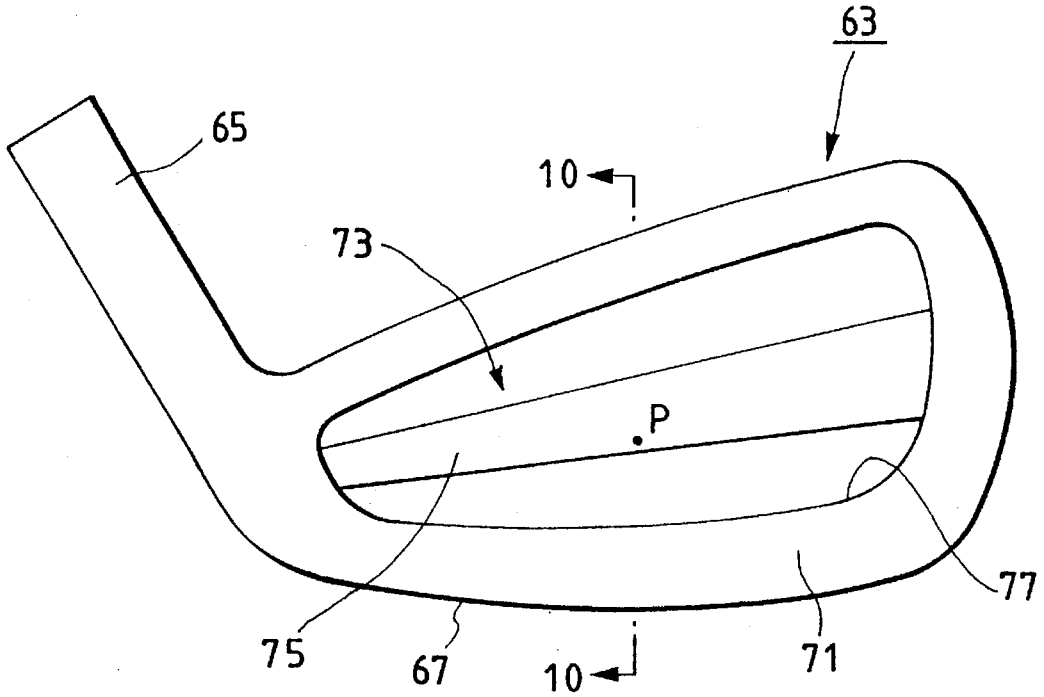
FIG. 9 is a back view of the golf club head shown in FIG. 8.
Figure 10:
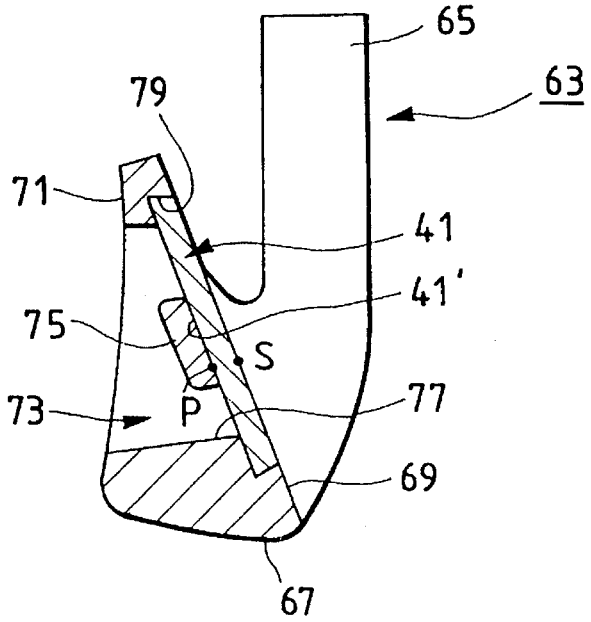
FIG. 10 is a section view taken along the line 10—10 of FIG. 9.

FIGS. 8 to 10 show a golf club head according to a third embodiment of the present invention. In these figures, reference character 63 designates a head main body of an iron club formed of stainless steel. The present head main body 63 also includes a hosel portion 65, a sole portion 67, a face portion 69 and the like which are formed integrally with one another, and the head main body 63 further includes a back portion 71 in which a recessed portion 73 is formed with the peripheral edge portion thereof remaining untreated or unrecessed.

In the recessed portion 73, a rib-shaped support portion 75, which is so disposed as to pass through the sweet spot corresponding position P and is gradually increased in width toward the toe side of the head main body 63, is provided integrally with the head main body 63 in such a manner that it extends from the heel side of the head main body 63 to the toe side thereof and is interposed between the mutually facing inner walls of the recessed portion 73.

Thus, in the present embodiment as well, as shown in FIGS. 9 and 10, a through hole 77 is so formed in the recessed portion 73 of the head main body 63 as to extend from the face portion 69 to the back portion 71 and then the face plate 41 is fitted into a fitting recessed portion 79 formed in the periphery of the through hole 77 and on the side of the face portion 69. As shown in FIG. 10, the rear surface 41' of the face plate 41 is in contact with and is supported by the support portion 75.

In this embodiment as well, the face plate 41 is so formed as to be identical in the outer shape thereof with the fitting recessed portion 79 and, when the face plate 41 is fitted into the fitting recessed portion 79, it can be surely set flush with the face portion 69.

Thus, in this embodiment, in the recessed portion 73 formed on the side of the back portion 71 of the head main body 63, the rib-shaped support portion 75, which passes through the sweet spot corresponding position P and increases gradually in width toward the toe side of the head main body 63, is provided integrally with the head main body 63. Thanks to this, according to the present embodiment as well, in spite of provision of the support portion 75, the weight of the head main body 63 can be dispersed to the peripheral edge portion thereof and thus the moment of inertia thereof is increased, while the surface rigidity of the sweet spot S is increased.

Accordingly, if a golf player swings a golf club incorporating a golf head according to the present embodiment, then the head main body 63 can draw an intended, accurate locus when hitting the ball so that the direction of the hit ball can be stabilized. At the same time, since the support portion 75 supports and reinforces the face plate 41 to thereby enhance the surface rigidity of the sweet spot S, there is eliminated the possibility that the face plate 41 can be broken or damaged by shocks given in the ball hitting time.

Further, in the present embodiment as well, since the surface of the support portion 75 for supporting the face plate 41 forms a surface substantially parallel to the ball hitting surface of the face plate 41, the support portion 75 is able to support the face plate 41 to efficiently and effectively convert the elastic property thereof into repulsive energy.

The elastic or repulsive property and the high surface rigidity of the sweet spot S combined enables the present embodiment to secure the stabilized direction of the hit ball as well as to extend the carry of the hit ball.

Further, due to provision of the face plate 41 that is formed separately from the lead main body 63, it is possible to select the highly elastic material that is suitable for hitting the ball, as the material of the face plate 41 and also, since the head main body 45 includes the through hole 77, the repulsive property inherent in the elastic material thereof can be used effectively.

Further, even if the concentrated stresses in the ball hitting time cause the face plate 41 to bend to some degree, the present embodiment is surely able to prevent the separation and damage of the face plate 41 since the support portion 75 enhances the surface rigidity of the face plate 41 and acts in cooperation with the head main body 63 to prevent the excessive bending of the face plate 41 occurring in the ball hitting time.

In addition, according to the present embodiment, since the support portion 75 is formed in such a manner that the width thereof is gradually increased from the heel side of the head main body 63 toward the toe side thereof, the support portion 75 is also able to enhance the head speed of the head main body 63.

Figure 11:
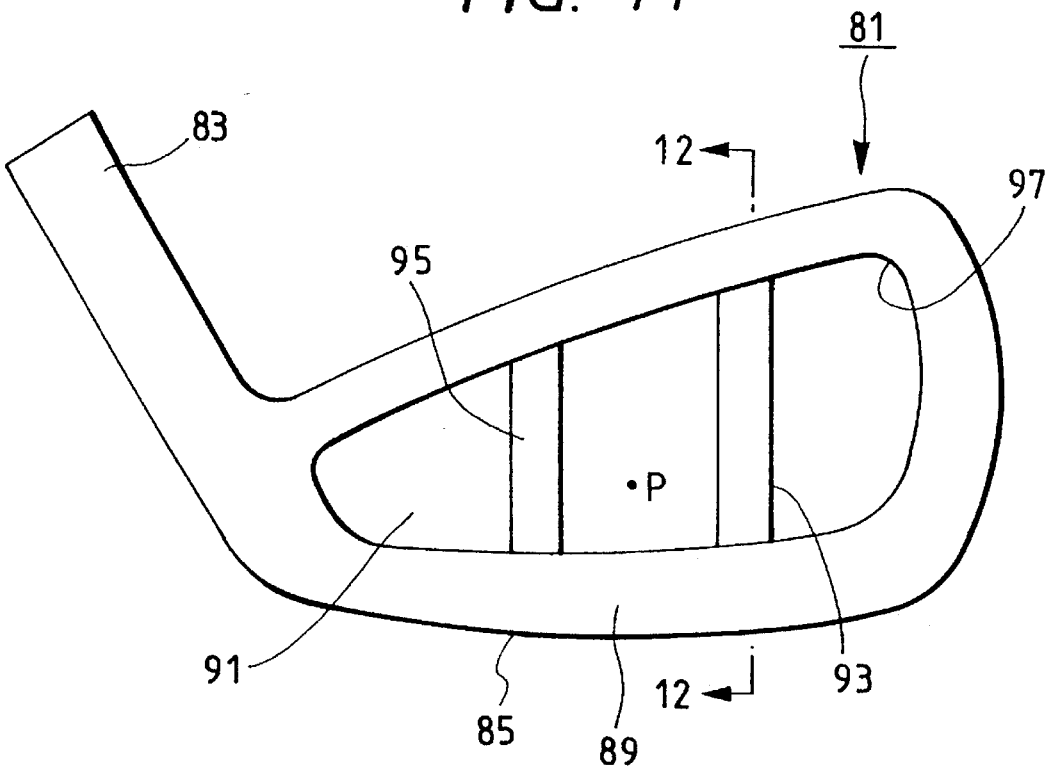
FIG. 11 is a back view of a golf club head according to a fourth embodiment of the invention.
Figure 12:
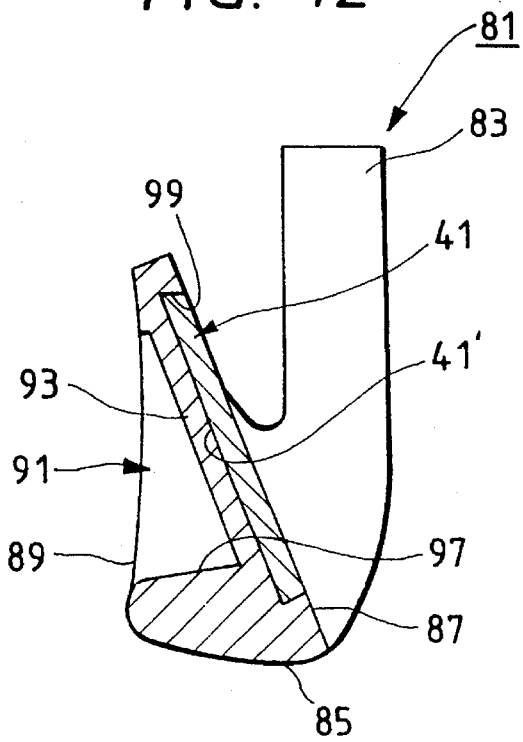
FIG. 12 is a section view taken along the line 12—12 of FIG. 11.

FIGS. 11 and 12 show a golf club head according to fourth embodiment of the present invention, and, in these figures, reference character 81 designates a head main body of an iron club which is formed of stainless steel. The present head main body 81, similarly to the previously described head main bodies, includes a hosel portion 83, a sole portion 85, a face portion 87 and the like which are formed integrally with one another, and further includes a back portion 89 in which a recessed portion is formed with the peripheral edge portion thereof remaining unrecessed.

In the recessed portion 91, two rib-shaped support portions 93 and 95 respectively smaller in thickness than the peripheral edge portion of the head main body are provided integrally on the toe and heel sides of the head .lain body 81 with the sweet spot corresponding position P be located between them. The support portions 93 and 95 are also interposed between the mutually facing inner walls of the recessed portion 91 and extend from the top side of the head main body 81 to the sole side thereof.

As shown in FIG. 12, a through hole 97 is formed in the recessed portion of the head main body 81 in such a manner that it extends from the face portion 87 to the back portion 89, and a face plate 41 is fitted into a fitting recessed portion 99 formed in the periphery of the through hole 97 and located on the side of the face portion 87. The back surface 41' of the face plate 41 is in contact with and is supported by the two support portions 93 and 95.

In the present embodiment as well, the outer shape of the face plate 41 is formed identical with the fitting recessed portion 99 and, when the face plate 41 is fitted into the fitting recessed portion 99, then the face plate 41 is set flush with the face portion 87.

As described above, in the present embodiment, unlike the previously described embodiments, in the recessed portion 91 of the back portion 89, the two thin rib-shaped support portions 93 and 95 extending from the top side of the head main body 81 to the sole side thereof are laterally provided on the toe and heel sides of the head main body 81 with the sweet spot corresponding position P be located between them. According to the present embodiment as well, since the support portions 93 and 95 are smaller in thickness than the conventional iron clubs respectively shown in FIG. 19 and its following figures, in spite of provision of the two support portions 93 and 95, the weight of the head main body 81 can be dispersed to the peripheral edge portion thereof and thus the moment of inertia thereof id increased, while the surface rigidity of the sweet spot S is increased due to the support portions 93 and 95.

Therefore, if a golf player swings a golf club incorporating a golf club head according to the present embodiment, then the head main body 81 does not shift but can draw an accurate locus due to its moment of inertia. That is, according to the present embodiment as well, when compared with the conventional iron clubs shown in FIG. 19 and its following figures, the direction of the hit ball can be stabilized and, at the same time, since the support portions 93 and 95 support and reinforce the face plate 41 to thereby enhance the surface rigidity of the sweet spot S, there is eliminated the danger that the face plate 41 can be broken due to shocks given in the ball hitting time as in the conventional iron club shown in FIG. 16.

According to the present embodiment as well, since the surfaces of the support portions 93 and 95 for supporting the face plate 41 form surfaces substantially parallel to the ball hitting surface of the face plate 41, the support portions 93 and 95 can support the face plate 41 effectively and can use and convert the elastic property into repulsive energy efficiently.

This property and the high surface rigidity of the sweet spot S combined enable the present embodiment to secure the stabilized direction of the hit ball as well as to extend the carry of the hit ball, when compared with the conventional golf club heads.

Further, in the present embodiment as well, due to provision of the face plate 41 that is formed separately from the head main body 81, as the material of the face plate 41, the highly elastic material that is suitable for hitting the ball can be selected. Also, since the head main body 81 includes the through hole 97, the repulsive property inherent in the elastic material thereof can be used effectively.

In addition, even if stresses produced at the time of the ball hitting are concentrated to attempt to force the face plate 41 bend to some degree, the present embodiment is sure to prevent the separation and damage of the face plate 41 since the two support portions 93 and 95 enhance the surface rigidity of the face plate 41 and act in cooperation with the head main body 81 to relieve the bending of the face plate 41 occurring upon the ball hitting.

Figure 13:
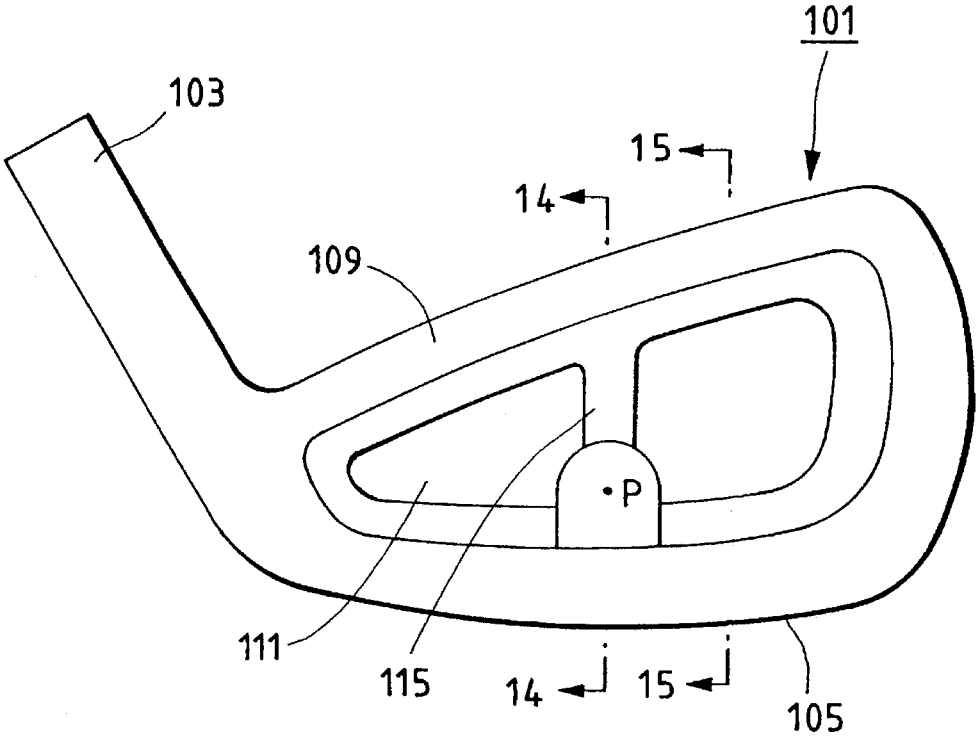
FIG. 13 is a back view of a golf club head according to a fifth embodiment of the invention.
Figure 14:
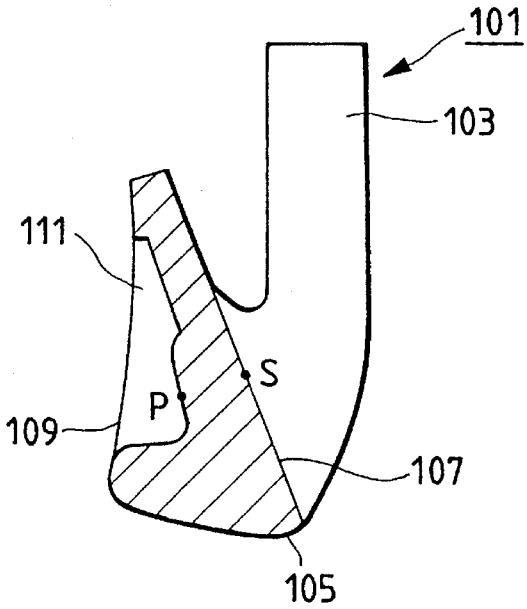
FIG. 14 is a section view taken along the line 14—14 of FIG. 13.
Figure 15:
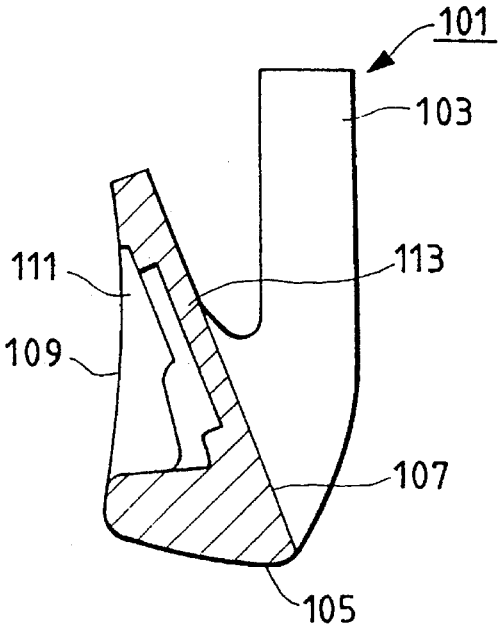
FIG. 15 is a section view taken along the line 15—15 of FIG. 13.

FIGS. 13 to 15 show a golf club head according to a fifth embodiment of the present invention. In the previously described embodiments, for example, as shown in FIGS. 2 to 4, the through hole 37 is formed in the head main body 23 and the face plate 41 lighter in specific gravity than the head main body 23 is mounted to the face portion 29, thereby forming the recessed portion 33 in the back portion 31. However, in the present embodiment, unlike the previous embodiments, no through hole is formed ill the lead main body but a recessed portion is formed in the back portion of the head main body, thereby forming a thin ball hitting surface in the face portion.

Description will be given below in more detail of the present embodiment with reference to FIGS. 13 to 15. In these figures, reference character 101 designates a head main body of an iron club formed of stainless steel and the present head main body 101, similarly to the conventional ones, includes a hosel portion 103, a sole portion 105, a face portion 107 and the like which are formed integrally with one another.

As shown in FIG. 15, in the back portion 109 of the head main body 101, there is formed a recessed portion 111 with the peripheral edge portion of the back portion 109 remaining unrecessed. By forming the recessed portion 111 in the back portion 109 of the head main body 101 in this manner, a thin ball hitting surface 113 is formed integrally in the face portion 107.

On the rear surface of the ball hitting surface 113, that is, the bottom of the recessed portion 111, a rib-shaped support portion 115 having a smaller thickness than the peripheral edge portion of the back portion 109 is provided integrally with the head main body 101 in such a manner that it passes through the sweet spot corresponding position P. The support portion 115 also extends from the top side of the head main body 101 to the sole side thereof as well as is interposed between the mutually facing inner walls of the recessed portion 111. The support portion 115 is so formed as to be larger in thickness at the sweet spot corresponding position P. That is, by making the support portion 115 thicker at the sweet spot corresponding position P in this manner, the surface rigidity of the sweet spot S is increased further.

As described above, in the present embodiment, not only the recessed portion 111 is formed in the back portion 109 of the head main body 101 to form the thin ball hitting surface 113 in the face portion 107, but also, in the recessed portion 111, the support portion 115 smaller in thickness than the peripheral edge portion thereof is provided integrally with the head main body 101 in a manner to extend from the top side of the head main body 101 to the sole side thereof and the support portion 115 is made thicker only at the sweet spot corresponding position P. Therefore, similarly to the embodiment shown in FIG. 1, according to the present embodiment as well, in spite of provision of the support portion 115, the weight of the head main body 101 can be dispersed to the peripheral edge portion thereof and thus the moment of inertia of the head main body 101 is increased and, at the same time, the surface rigidity of the sweet spot S is increased.

Accordingly, if a golf player swings a golf club incorporating a golf club head according to the present embodiment, then the head main body 101 does not shift but can draw an accurate locus due to the moment of inertia thereof. That is, according to the present embodiment, the direction of the hit ball can be stabilized and also, since the support portion reinforces the ball hitting surface 113 to thereby enhance the surface rigidity of the sweet spot S, there is eliminated the possibility that the ball hitting surface 113 can be broken. The combination of this property with the high surface rigidity of the sweet spot S enables the present embodiment to secure the stable direction of the hit ball as well as to extend the carry of the hit ball.

As has been described heretofore, according to the present invention, in spite of provision of the support portion, since the support portion is small in thickness, the weight of the head main body can be dispersed to the peripheral edge portion thereof and thus the moment of inertia of the head main body is increased. Also, provision of the support portion can increase the surface rigidity of the ball hitting surface of the face plate and the like when compared with the conventional golf club heads.

Accordingly, if a golf player swings a golf club incorporating the golf club head according to the present invention, then the head main body does not shift but can draw an, intended accurate locus due to the moment of inertia thereof when hitting the ball to thereby be able to stabilize the direction of the hit ball. Further, since the support portion reinforces the ball hitting surface of the face plate and the like to thereby enhance the surface rigidity thereof, there is eliminated the possibility that the ball hitting surface can be broken due to shocks given when hitting the ball. The combination of this property with the increased surface rigidity can extend the carry of the lit ball.

And, since the support portion passes through the sweet spot corresponding position, or since the two support portions are disposed respectively on the heel and toe sides with the sweet spot corresponding position be located between them, the surface rigidity of the sweet spot is enhanced, so that the carry of the hit ball can be further extended.

Further, when the face plate formed separately from the head main body is used, then the highly elastic material that is suitable for hitting the ball can be selected as the material of the face plate. When the head main body includes the through hole, the repulsive property inherent in the elastic material thereof can be used effectively.

Now, description will be given below in detail of an embodiment of a golf club set according to the invention with reference to the accompanying drawings.

Figure 16:
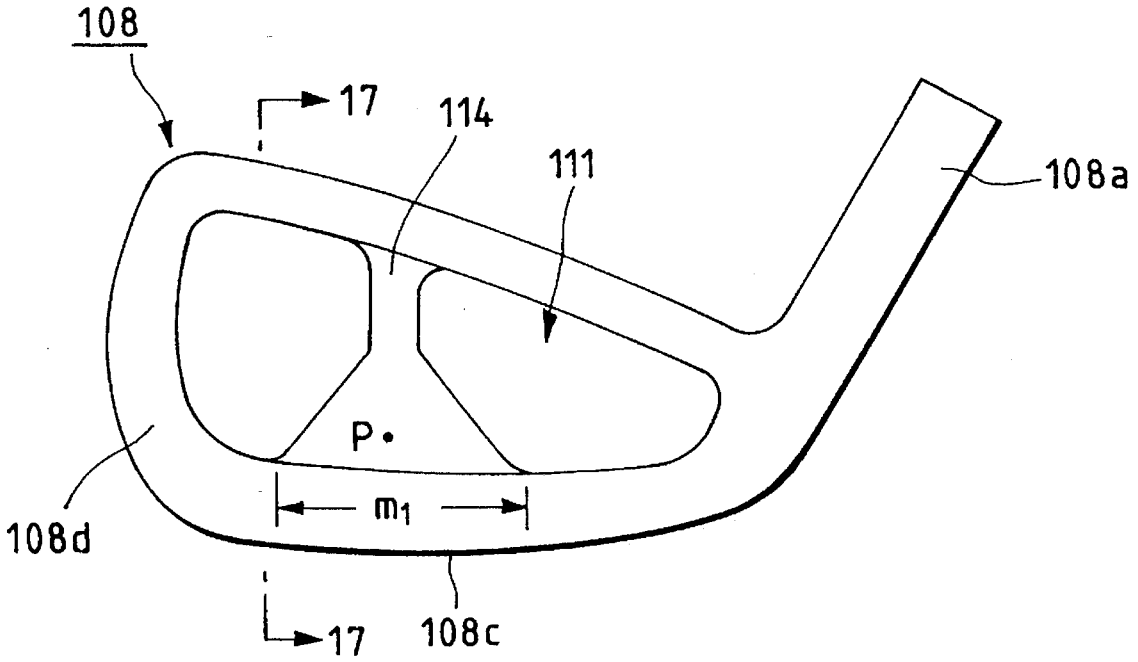
FIG. 16 is a back view of a head main body provided in a No. 2 iron club included in a gold club set according to a sixth embodiment of the invention.
Figure 17:
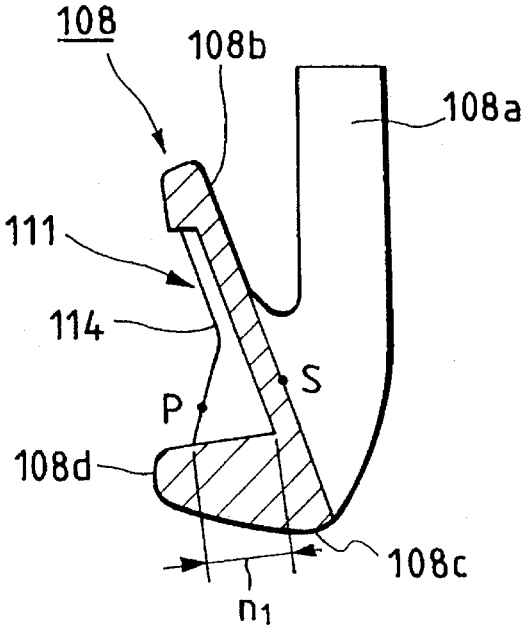
FIG. 17 is a section view taken along the line 17—17 of FIG. 16.
Figure 18:
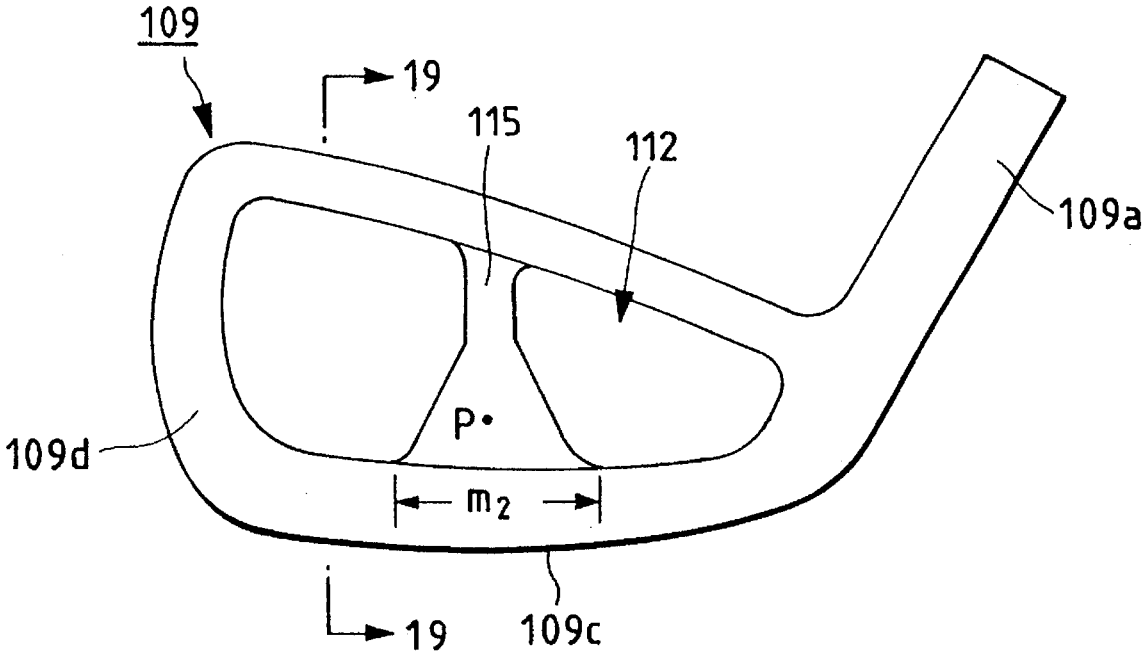
FIG. 18 is a back view of a head main body provided in a No. 5 iron club included in the golf club set according to the sixth embodiment of the invention.
Figure 19:
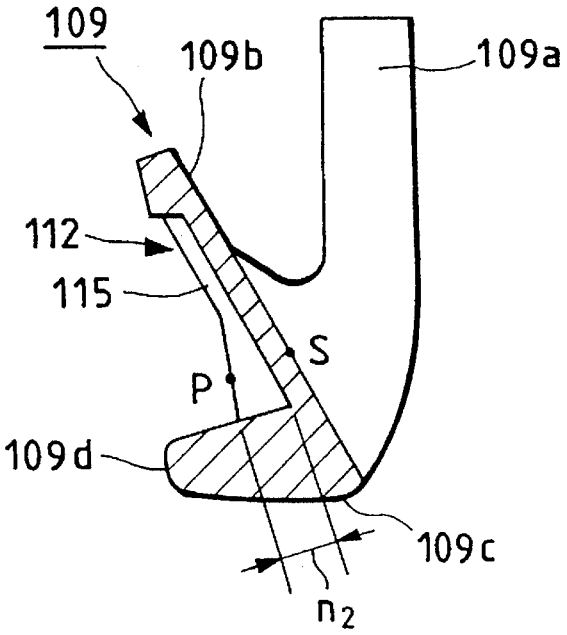
FIG. 19 is a section view taken along the line 19—19 of FIG. 18.
Figure 20:
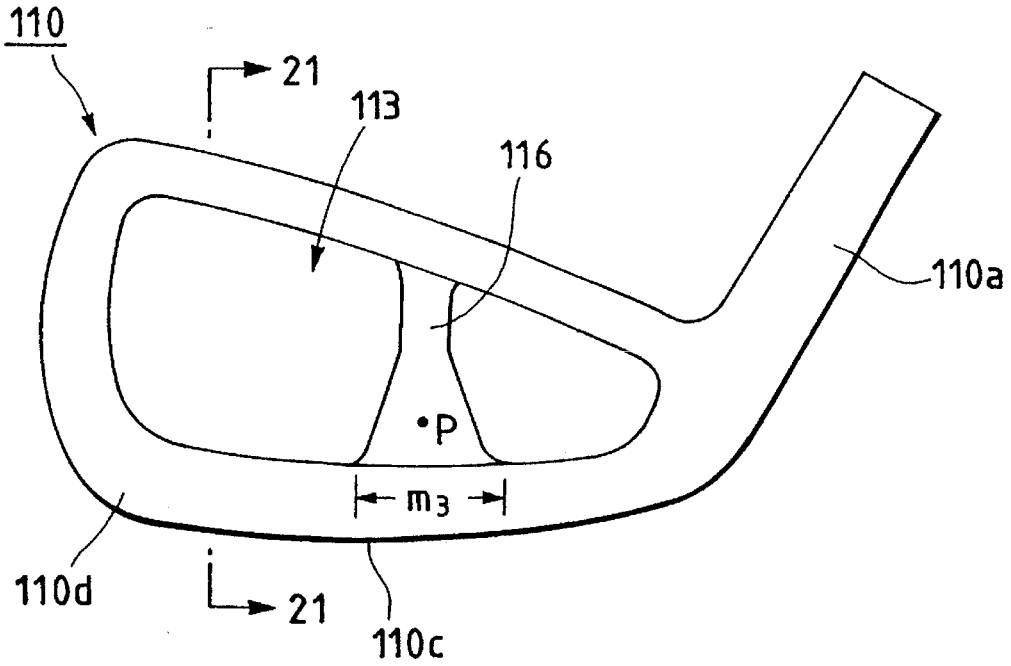
FIG. 20 is a back view of a head main body provided in a No. 8 iron club included in the golf club set according to the sixth embodiment of the invention.
Figure 21:
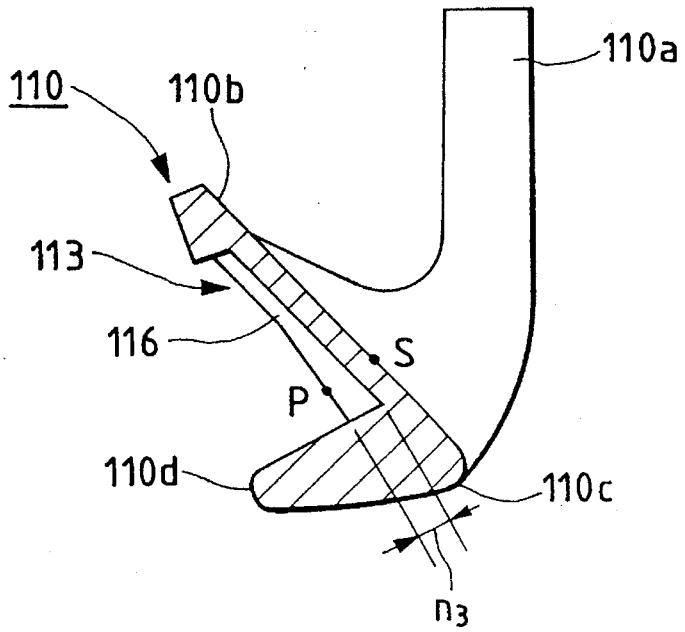
FIG. 21 is a section view taken along the line 21—21 of FIG. 20.

FIGS. 16 and 17 respectively show a back view and a section view of a head main body of a No. 2 iron included in a golf club set according to a sixth embodiment of the present invention, FIGS. 18 and 19 respectively show a back view and a section view of a head main body of a No. 5 iron included in the present embodiment, and FIGS. 20 and 21 respectively show a back view and a section view of a head main body of a No. 8 iron included in the present embodiment. The head main bodies 108 to 110 respectively includes hosel portions 108*a* to 110*a*, face portions 108*b* to 110*b*, sole portions 108*c* to 110*c* and the like which are formed of stainless steel and are formed integrally with one another, while the angles of loft of the head main bodies are set greater as the number of the iron clubs increases.

In the respective back portions 108*d* to 110*d* of the head main bodies 108 to 110, there are formed recessed portions 111 to 113 with the respective peripheral edge portions remaining unrecessed. In the respective recessed portions 111 to 113, rib-shaped support members 114 to 116 each having a thickness smaller than the respective peripheral edge portions are respectively provided integrally with the respective head main bodies 108 to 110 in such a manner that they pass through a sweet spot corresponding position P (that is, a position in which a perpendicular line drawn down from the sweet spot S of the ball hitting surface to the back portion 108*d* intersects the back portions 108*d*). The support members 114 to 116 are respectively formed such that they are sequentially increased in width and thickness toward the respectively sole sides in the sweet spot corresponding position P. The present embodiment is characterized in that, as the number of the irons increases from the long irons to the short iron, the widths $m_1$ to $m_3$ and thicknesses $n_1$ to $n_3$ of the support members 114 to 116 on the lower peripheral sides are sequentially reduced ($m_1>m_2>m_3$, $n_1>n_2>n_3$) to thereby reduce the weight of the support members 114 to 116 on the respective sole sides thereof sequentially.

Accordingly, since the support members 114 to 116 are formed in the above-mentioned manner, the weight of the head main body 108 of the long iron on the side of the sole portion 108*c* thereof is heavier when compared with the middle and short irons. Due to this, the center of gravity of the head main body 108 is situated lower, the thickness of the sweet spot 105 thereof is larger and the surface rigidity thereof is greater, when compared with the middle and short irons.

As the number of the irons increases from the long iron to the middle and short irons, the centers of gravity of the head main bodies 109 and 110 are sequentially moved upward, and the surface rigidity of the sweet spot S is sequentially lowered in order to lengthen the time period in which the ball is in contact with face portion during the hitting of the ball.

Figure 25:
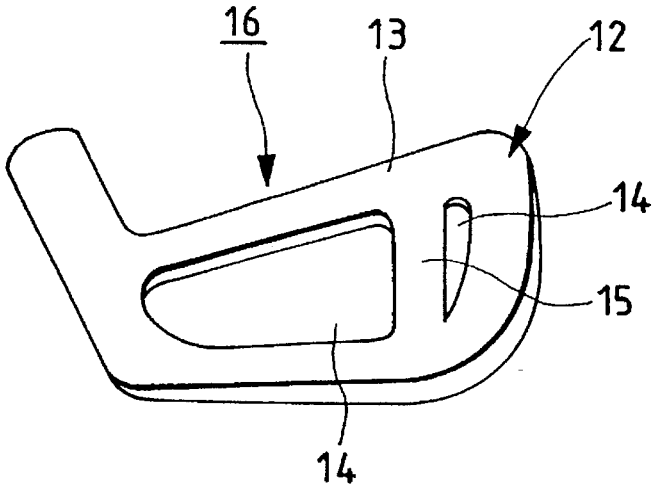
FIG. 25 PRIOR ART
FIG. 25 is a back side perspective view .of still another conventional golf club head.
Figure 26:
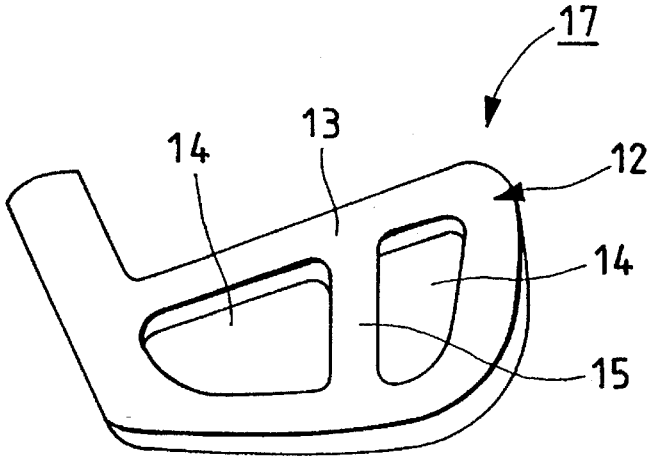
FIG. 26 PRIOR ART
FIG. 26 is a back side perspective view of a further conventional golf club head.
Figure 27:
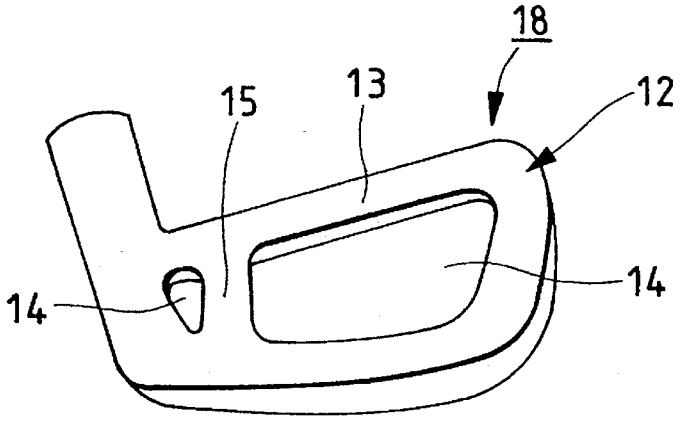
FIG. 27 PRIOR ART
FIG. 27 is a back side perspective view of a still further conventional golf club head.

Here, the sole side weight of the head main body 109 of the No. 5 iron shown in FIG. 18 is set substantially equal to the sole side weight of the head main body 1 of the iron included in the conventional golf club set shown in FIG. 25. As described above, FIGS. 16 to 21 show only the No. 2 iron, No. 5 iron and No. 8 iron selected from the golf club set according to the present embodiment. Of course, this applies to the respective heads of the remaining irons included in the present golf club set. That is, as the number of the irons increases in the order of the long, middle and short irons, the respective sole side widths and thickness of the support members thereof are sequentially reduced and thus the sole side weight of the support members is sequentially reduced.

Since the present embodiment is structured in this manner, when the ball is hit by the respective iron clubs, as described above, the long iron according to the present embodiment can fly the ball higher and farther with the faster initial speed thereof when compared with the conventional irons, because the center of gravity of the head main body 108 of the long iron is lower and the surface rigidity of the sweet spot S thereof is greater when compared with the middle and short irons.

Therefore, according to the present embodiment, the carry of the ball hit by the long iron can be extended when compared with the conventional long iron.

Further, since the centers of gravity of the head main bodies 109 and 110 are sequentially moved upward as the number of the irons increases, the direction of the heads (faces thereof) can be intentionally changed easier to thereby facilitate the control of the direction of the hit ball and, at the same time, when compared with the long irons, the surface rigidity of the sweet spot S of the middle and short irons is reduced in comparison to the long iron to thereby extend the time period of contact with the ball in hitting the ball, so that more spin can be given to the ball.

Therefore, with use of the middle and short irons according to the present embodiment, when compared with the conventional ones, the direction of the hit ball can be controlled with more ease, and more spins can be given to the ball to thereby provide a sharper shot.

Moreover, in the conventional golf club set, the sweet spot is moved from the toe side of the head main body to the heel side thereof as the number of the irons increases. On the other hand, according to the present embodiment, since the support members 114 to 116 are respectively formed in the recessed portions 111 to 113 in such a manner that they pass through the sweet spot corresponding position P, as the sweet spot S is moved in the order of the long, middle and short irons, the support members 114 to 116 are respectively moved from the toe sides of the head main bodies 108 to 110 to the heel sides thereof and thus, when hitting the ball, the support members 114 to 116 can support the head main bodies 108 to 110 in a proper angle of inclination to thereby prevent the ball from being hooked or sliced.

Thus, according to the present embodiment, the last mentioned effect and the previously mentioned effect combined can stabilize the direction of the hit ball when compared with conventional irons.

As described above, in the present embodiment, as the number of the irons increases in the order of the long, middle and short irons, both the widths $m_1$ to $m_3$ and the thickness of the support members 114 to 116 on the sole sides thereof are sequentially reduced to thereby decrease the weight of the support members 114 to 116 on the sole sides thereof sequentially. However, the invention is not limited to this but, alternatively, either the widths or thickness of the support members on the sole sides thereof may be reduced with the increasing number of the irons to thereby decrease the weight of the support members sequentially. Only one embodiment has been described for a golf club set of the present invention, but the present invention should not be restricted thereto or thereby. For example, if the arrangement that is explained along the first to fifth embodiments is utilized in a golf club set, the technical thought explained along the sixth embodiment is applicable to the golf club set.

In addition, since the peripheral portion is formed and the weight of the head is dispersed to the peripheral portion, the moment or inertia of the head is increased, so that the head does not shift but can be stabilized when hitting the ball. Because the support member is formed to be thin and thus the weight of the head is relatively light,the surface rigidity of the sweet spot can be enhanced while the above-mentioned large moment of inertia can be kept as it is.

What is claimed is:

1. A golf club head having a head main body, said golf club head comprising:

a face portion opposite from a back portion for defining a ball hitting surface;

a recessed portion formed in said back portion of said head main body;

a peripheral edge portion remaining unrecessed and circumscribing said recessed portion;

a support portion having a thickness smaller than a thickness of said peripheral edge portion, said support portion being integral with said head main body;

a through hole formed in said recessed portion to extend from said back portion to said face portion; and a face plate formed of material lighter in specific gravity than said head main body and fitted at said face portion, said face plate being in contact with said support portion.

2. A golf club head having a head main body, said golf club head comprising:

a face portion opposite from a back portion for defining a ball hitting surface;

a recessed portion formed in said back portion of said head main body;

a peripheral edge portion remaining unrecessed and circumscribing said recessed portion;

a support portion having a thickness smaller than a thickness of said peripheral edge portion, said support portion being integral with said head main body;

wherein, said support portion extends vertically from a top side of said head main body to a sole side thereof and is laterally spaced from substantially vertically extending portions of said peripheral edge potion, and a perpendicular line extending from a sweet spot and perpendicular to said ball hitting surface passes through said support portion.

3. A golf club head according to claim 2, wherein a portion of said support portion is larger in thickness than the rest of said support portion, said perpendicular line passing through said portion of said support portion.

4. A golf club head according to claim 3, wherein said portion of said support portion is larger in lateral width than the rest of said support portion.

5. A golf club head having a head main body, said golf club head comprising a face portion opposite from a back portion for defining a ball hitting surface;

a recessed portion formed in said back portion of said head main body;

a peripheral edge portion remaining unrecessed and circumscribing said recessed portion;

a support portion having a thickness smaller than a thickness of said peripheral edge portion, said support portion being integral with said head main body;

a through hole formed in said recessed portion to extend from said back portion to said face portion; and a face plate formed of material lighter in specific gravity than said head main body and fitted at said face portion, said face plate being in contact with said support portion;

wherein a perpendicular line extending from a sweet spot and perpendicular to said ball hitting surface passes through said support portion.

6. A golf club head according to claim 5, wherein a portion of said support portion is larger in thickness than the rest of said support portion, said perpendicular line passing through said portion of said support portion.

7. A golf club head according to claim 6, wherein said portion of said support portion is larger in lateral width than the rest of said support portion.

8. A golf club head having a head main body, said golf club head comprising:

a face portion opposite from a back portion for defining a ball hitting surface;

a recessed portion formed in said back portion of said head main body;

a peripheral edge portion remaining unrecessed and circumscribing said recessed portion;

a support portion having a thickness smaller than a thickness of said peripheral edge portion, said support portion being integral with said head main body;

a circumferential step portion extending from said peripheral edge portion to said recessed portion;

a through hole formed in said recessed portion to extend from said back portion to said face portion; and a face plate formed of material lighter in specific gravity than said head main body and fitted at said face portion, said face plate being in contact with said support portion.

* * * * *